US007070479B2

(12) United States Patent
Faustmann et al.

(10) Patent No.: US 7,070,479 B2
(45) Date of Patent: Jul. 4, 2006

(54) ARRANGEMENT AND METHOD FOR CONDITIONING A POLISHING PAD

(75) Inventors: Peter Faustmann, Dresden-Weixdorf (DE); Walter Glashauser, Oberhaching (DE); Andreas Purath, Dresden (DE); Benno Utess, Dresden-Weixdorf (DE)

(73) Assignee: Infineon Technologies AG, Munich (DE)

( * ) Notice: Subject to any disclaimer, the term of this patent is extended or adjusted under 35 U.S.C. 154(b) by 154 days.

(21) Appl. No.: 10/480,807

(22) PCT Filed: Jun. 20, 2002

(86) PCT No.: PCT/EP02/06856

§ 371 (c)(1),
(2), (4) Date: May 14, 2004

(87) PCT Pub. No.: WO03/000462

PCT Pub. Date: Jan. 3, 2003

(65) Prior Publication Data

US 2004/0192168 A1 Sep. 30, 2004

(30) Foreign Application Priority Data

Jun. 22, 2001 (EP) ..... 01115218

(51) Int. Cl.
*B24B 49/00* (2006.01)
*B24B 51/00* (2006.01)
*B24B 1/00* (2006.01)

(52) U.S. Cl. ..... 451/21; 451/56; 451/72

(58) Field of Classification Search ..... 451/5, 451/6, 8, 9, 21, 22, 56, 72, 443
See application file for complete search history.

(56) References Cited

U.S. PATENT DOCUMENTS 5,609,718 A * 3/1997 Meikle ..... 438/14
5,655,951 A * 8/1997 Meikle et al. ..... 451/56
5,801,066 A * 9/1998 Meikle ..... 438/14
5,951,370 A * 9/1999 Cesna ..... 451/21
5,975,994 A 11/1999 Sandhu et al.
6,040,244 A * 3/2000 Arai et al. ..... 438/691

(Continued)

FOREIGN PATENT DOCUMENTS

EP 1 060 835 A2 12/2000

(Continued)

*Primary Examiner*—Timothy V. Eley
(74) *Attorney, Agent, or Firm*—Edell, Shapiro & Finnan, LLC

(57) ABSTRACT

An in-situ measurement of thickness profiles of polishing pads (1) used in chemical mechanical polishing (CMP) is enabled by arranging sensors (7) for measuring distances together with a conditioner (6). The sensors (7) are provided as e.g. laser sensors (7*a–c*) performing an indirect measurement from a calibrated height level above the pad (1) surface or as e.g. laser (7*a–c*) or ultrasonic sensors (7*e*) performing a direct thickness measurement from the pad surface to the pad-platen contact surface. A thickness profile (10) is obtained by co-moving the sensor (7*a*, 7*b*) with the conditioner (6) during conditioning or by leading a sensor (7*c*) along a guide-rail (14) above the pad surface (1) with e.g. a constant distance. A reference distance measurement to the polishing platen (2) can be achieved by a second sensor (7*d*) mounted at a position, where there is no pad on the platen (2), e.g. a hole or the edge. Using the arrangement a disadvantageous thickness profile (10) with a steep slope resulting in polishing inhomogeneities affecting semiconductor device (4) surfaces can be detected and a warning signal be issued. A destructing micrometer measurement is not necessary, thus prolonging the pad (1) lifetime and increasing the device yield.

9 Claims, 4 Drawing Sheets

U.S. PATENT DOCUMENTS 6,129,609 A 10/2000 Ripper et al.
6,194,231 B1 * 2/2001 Ho-Cheng et al. ..... 438/8
6,354,910 B1 * 3/2002 Adebanjo et al. ..... 451/21

FOREIGN PATENT DOCUMENTS

EP 1 063 056 A2 12/2000

* cited by examiner

ARRANGEMENT AND METHOD FOR CONDITIONING A POLISHING PAD

FIELD OF THE INVENTION

The present invention relates to an arrangement and method for conditioning a polishing pad, which is designed to perform chemical mechanical polishing of semiconductor devices.

BACKGROUND

An apparatus for chemical mechanical polishing (CMP) typically comprises a rotation table, on which a polishing pad conventionally made of polyurethane is mounted. A rotatable polishing head holds the wafer, which is to be polished, and engages the wafer against the rotating wetted polishing pad. During polishing, the polishing head, which either co-rotates or counter-rotates with the polishing pad, can vary its position relative to the axis of the rotation table due to an oscillating arm. Thereby, the textured polishing pad surface receives a so-called slurry which serves for abrading the wafer surface.

The slurry typically contains particles of, e.g., aluminum oxide or silicon dioxide in de-ionized water with a variety of chemical alloys to chemically oxidate and mechanically abrade surface material. By use of those chemical alloys, a high selectivity of the polishing rates of, e.g., polysilicon or tungsten against silicon dioxide can be maintained during planarization.

The abrasion rate depends on the respective rotation velocities of the tables and heads, the slurry concentration and the pressure with which the polishing head is engaged against the polishing pad.

Generally, polishing pads are affected by deterioration, since the uniform, textured and profiled pad surface is obliterated with removed wafer surface material, chemically altered slurry material, or deteriorated pad surface material, which is often referred to as the "pad glazing effect".

This effect can be remedied by performing a conditioning step in which glass-like material as well as the uppermost deteriorated pad layer is removed from the pad by means of a conditioning disk. Thereby, the pores, which are to receive the slurry, are re-opened resulting in a restored pad functionality.

The process of conditioning can be carried out either during or after the polishing step. In one example, diamond emery paper is mounted on a conditioning head, which analogously to the polishing head, is carried by an additional oscillating arm. Diamond particles are encapsulated in a nickel grit mounted on a socket layer. The diamond particles are protruding from the nickel surface to various extents—ranging from being fully encapsulated to just being slightly stuck to the nickel layer.

The so structured conditioning pad grinds over the resilient polyurethane or similar polishing pad surface in a rotation movement of the conditioner, which is engaged onto the polishing pad. After the conditioning step, the efficiency of abrading is substantially restored, resulting in a prolonged lifetime of the pad and less operator efforts to replace deteriorated pads. Nevertheless, due to removing 0.2–1.5 μm of pad material thickness per conditioning cycle, the improved lifetime of the polishing pad due to performing the conditioning step is limited to, e.g., 12–18 hours, after which the polishing pad being mounted to the rotation table by adhesive means is to be replaced by a new one. Typically, the conditioning cycle performed after each wafer polishing needs 40–60 seconds of time. A typical polishing cycle takes about 2 minutes. Only roughly 500–1000 wafers can be polished with one pad, nowadays. New polishing pads typically start with 1–2 mm thickness. The lifetime of a pad depends on factors such as thickness removal and homogeneity, etc.

In polishing semiconductor wafers, a high degree of uniformity is needed in order to remove surface material under precisely determined removal rates. Non-uniformity can inevitably lead to specification violation of layer thicknesses and thus to a disadvantageous decrease in yield of the polishing process.

One cause for this non-uniformity can often be derived from a development of a polishing pad profile in an advanced state of conditioning. Under normal conditions, the centre and the edge areas of a polishing pad mounted on a polishing platen are neither affected by polishing nor by conditioning. Therefore, pad surface areas in the vicinity of the central area or the edges are less strongly affected by conditioning removal of surface material than the area having a radius within both limits, resulting in a significant slope of the polishing pad thickness profile. Additionally, material inhomogeneities can lead to local elevations affecting the wafer surface during polishing.

In prior art, this problem has been addressed by removing the polishing pad from the polishing platen and performing a high-precision thickness profile measurement using, e.g., a micrometer. This procedure is disadvantageously connected with time consuming profile measurements as well as the handicap of destroying the polishing pad under investigation, such that the measurement result cannot directly be reused for the current pad. Rather, a trend can be estimated of how efficient the current conditioning is, and how long a pad can generally be used until its lifetime ends. If, alternatively, problems with the CMP-apparatus quickly evolve, too many wafers are disadvantageously processed until the problem is found and a reaction can be taken.

SUMMARY

It is therefore a primary objective of the present invention to increase the yield in chemical mechanical polishing by achieving a better polishing uniformity, and to decrease the time needed to find and react to process problems. It is a further object to decrease the amount of time spent in polishing pad uniformity measurements and to reduce material costs of polishing pads.

An arrangement and a method for conditioning a polishing pad can perform chemical mechanical polishing of semiconductor devices. The polishing pad can be mounted on a rotatable polishing platen. The arrangement and method includes a conditioner having a conditioning disk, and movable across the polishing pad, a measurement unit for measuring the thickness of the polishing pad, which comprises a sensor for measuring a distance between a reference level and a surface element of said polishing pad, and a control unit, which is connected to the at least one sensor, for calculating the thickness of the polishing pad from the distance measurement.

According to the present invention, an in-situ measurement of a polishing pad thickness profile is enabled by providing a measurement unit with the conditioner. Therefore, a destruction of the polishing pad due to a removal off the polishing platen followed by a measurement with, e.g., a micrometer is not necessary. The resulting profile after a conditioning cycle can be available immediately after finishing the conditioning step or even during the same. As a result, the polishing pad needs only to be removed when a measurement of the thickness or thickness profile reveals that the polishing pad is such deteriorated that further use for performing chemical mechanical polishing leads to a disadvantageous reduction of wafer yield. Since using the present arrangement, the corresponding time step can be determined, an optimum use of polishing pads can be provided, thereby saving material costs, operator time for removing the polishing pad, and of operator time that is conventionally used for performing the micrometer measurement.

In a further aspect of the present invention, the motor that rotates the conditioning disk of the conditioner with an angular velocity is considered to be connected to the control unit of the measurement unit. Implicitly, a closed loop control circuit is provided that enables a higher angular velocity, and thus a more efficient removal of polishing pad surface material in response to polishing pad profile inhomogeneities detected by the measurement unit according to the present invention.

For example, the steeper profile of the polishing pad, which often develops near the outer edge or near the central area of the polishing pad—the latter usually not being conditioned, can thereby be detected and the control unit performs a calculation of how much surface material is to be removed at which position to compensate for a slope. With a relation between angular velocity and removal rate, the conditioning disk rotation can be controlled to correct for the profile inhomogeneities during the present or next or any further cycle. Alternatively, local elevations or profile slopes can be detected immediately at the position of the conditioning disk, e.g., by a co-moving sensor. A feedback to the conditioning disk angular velocity via the control unit can be then given immediately. In order to perform this closed loop control circuit, a threshold value is provided for deciding whether the polishing pad profile is within tolerance or not.

In a further aspect, a similar closed loop control circuit is provided by the connection between the control unit of the measurement unit and the means for exerting a downward pressure force of the conditioning disk onto the polishing pad. The downward pressure force also correlates with the surface material removal rate of the polishing pad at a given angular velocity. The corresponding feedback loop of detecting elevations or slopes of the polishing pad thickness profile and adjusting the downward pressure force in response to a similar threshold violation as in the case of angular velocity is analogously provided. In a preferred embodiment, a feedback-control of the measurement unit by means of the control unit to said motor for rotating the conditioning disk and the means for exerting the downward pressure force, i.e., the combination of both, is provided.

The sensor of the measurement unit is preferably either a laser sensor or an ultrasonic sensor. Both sensor types are known to be available with a precision large enough to detect thickness differences before and after a cycle typically amounting to 0.2–1.5 μm of pad removal.

In order to perform a thickness profile measurement, it is necessary that a sensor takes different positions across the pad. On the one hand side, the present invention provides aspects where the sensors are supplied with mobility for receiving the desired position. On the other hand side, it is also possible that an array of sensors, preferably laser sensors, are mounted fixed at their measurement position as is considered in a further aspect.

In a still further aspect, the array of laser sensors is arranged such that the active polishing surface of the rotating polishing pad is fully covered by the array. While the array preferably takes a fixed position during measurement, it is also preferred that the array can be removed for maintenance reasons.

The sensors that are movable to the desired position for performing a measurement can be mounted on a guide rail as in considered in a first aspect, or on the same support, e.g., the conditioning arm holding and moving the conditioner, as that which holds the conditioner and the conditioning disk. There can be mounted one, two, or any further number of laser sensors that are movable across the polishing pad on said guide rail or stage or support.

According to the present invention, a method for conditioning the polishing pad using the arrangement according to the present invention is also provided. During or after a conditioner and a conditioning disk are applied to a surface element of the polishing pad, whereby the conditioning disk has an angular velocity and a downward pressure force, a distance measurement between the surface element of the polishing pad and a reference level using at least one of the sensors is performed. From this distance measurement, the thickness of the polishing pad at the position of the surface element is calculated using a control unit.

For determining the thickness of the polishing pad, the sensors measure a distance between the surface element and the reference level. In the case of a direct thickness measurement, the sensor has contact with the surface element of the polishing pad and the reference level is the bottom surface of the polishing pad that contacts with the polishing platen.

If a laser sensor is used, e.g., using a position-sensitive device (PSD) for determining the distance, a hole can be provided with the polishing pad through which the laser beam can traverse towards the polishing platen surface. In case of a rotating polishing platen, such a hole is to be implemented having a periodic structure for providing a periodic distance signal to the laser, e.g., one hole for a whole circle at a given pad radius. When the polishing pad is not rotating, the laser sensor and the polishing pad have to be brought into a relative position that enables a distance measurement through such a hole at the laser position. It provides a reference level measurement.

Such a hole extends completely through the pad thickness for providing the laser beam to the platen surface. It must not be confused with holes or spiral curves in the pad, that serve for holding or keeping slurry during polishing.

In case that an ultrasonic sensor is used, the sensor is contacted with the polishing pad surface and a runtime difference of the ultrasonic waves the structure of a stationary wave pattern is measured. Thereby, the reflection of the ultrasonic waves by the polishing platen at the bottom of the polishing pad that transmits the waves is utilised.

The indirect measurement is a contactless measurement with the laser sensor measuring its distance to the polishing pad surface, thereby having a gauged distance to the bottom surface of the polishing pad contacting the polishing platen surface. The difference between the distance sensor—pad surface and sensor—polishing platen surface then reveals the current pad thickness. An ultrasonic sensor or any other distance measuring sensor can also be used for this type of measurement.

Advantageously, the actual pad thickness which is left by the conditioner can then be monitored directly for each conditioning. Using this method, a destructing micrometer measurement of the thickness profile can be skipped.

For obtaining the thickness profile, a set of subsequent thickness measurements are performed. Different values of thickness of adjacent positional measurements indicate the existence of a slope or local elevations. A control unit performs such a comparison or slope determination and, by a further comparison with a threshold value, issues a signal being sent either to the motor for adjusting the angular velocity of the conditioning disk, or to the means for exerting a downward pressure force of the conditioning disk onto the polishing pad. It is also possible to issue a signal towards the motor controlling the conditioning arm movement, the signal for example initiating a slower movement of the conditioner while the angular velocity or the downward pressure force are held constant. Thereby, the integrated removal work of a surface element can be increased or decreased since the duration of the abrasion work is longer or shorter, respectively.

Further advantages and aspects are evident from the dependent claims.

The invention will be better understood by reference to embodiments taken in conjunction with accompanying drawings, wherein

BRIEF DESCRIPTION OF THE DRAWINGS

The invention will be better understood by reference to embodiments taken in conjunction with accompanying drawings, wherein.

DETAILED DESCRIPTION

Figure 1A:
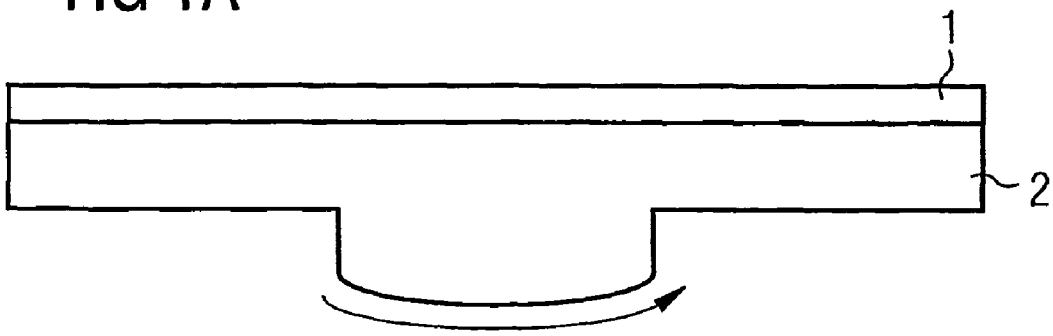
FIGS. 1A, 1B, and 1C show the problem of polishing pad thickness profile slope according to prior art conditioning.
Figure 1B:
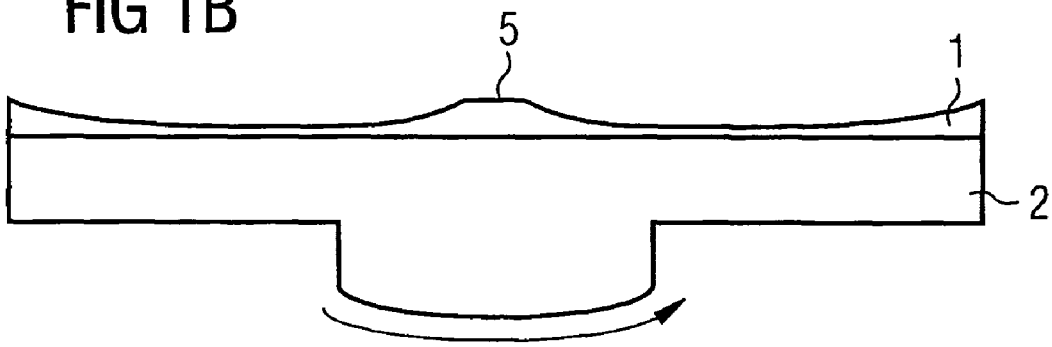
Figure 1C:
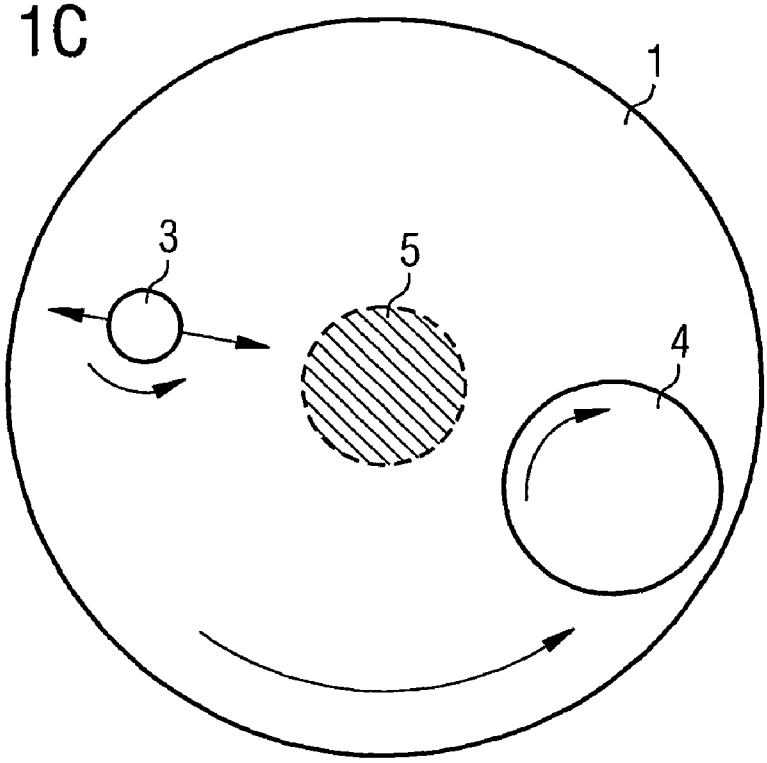

The problem of polishing pad thickness profile slopes resulting in inhomogeneities during chemical mechanical polishing of semi-conductor wafers 4 to be solved by the present invention is illustrated in FIGS. 1A, 1B, and 1C, as it appears in prior art. In a sideview, a polishing platen 2 being covered with a polishing pad 1 in a yet unused status is shown in FIG. 1A. After each conditioning cycle of a wafer 4, a conditioning step is performed by moving a rotating conditioning disk 3 across the rotating polishing pad 1 in an oscillating movement. Thereby, some amount of surface material of the polishing pad 1 is removed from the pad leading to a decrease in polishing pad thickness as illustrated in FIG. 1B. A central area 5 on the polishing pad that is not conditioned as well as the outer edge of the polishing pad 1 provide thickness boundary conditions of the polishing pad 1, both having a sloped transition to the conditioned area of the polishing pad 1. A top view of the polishing table is shown in FIG. 1C.

Figure 2A:
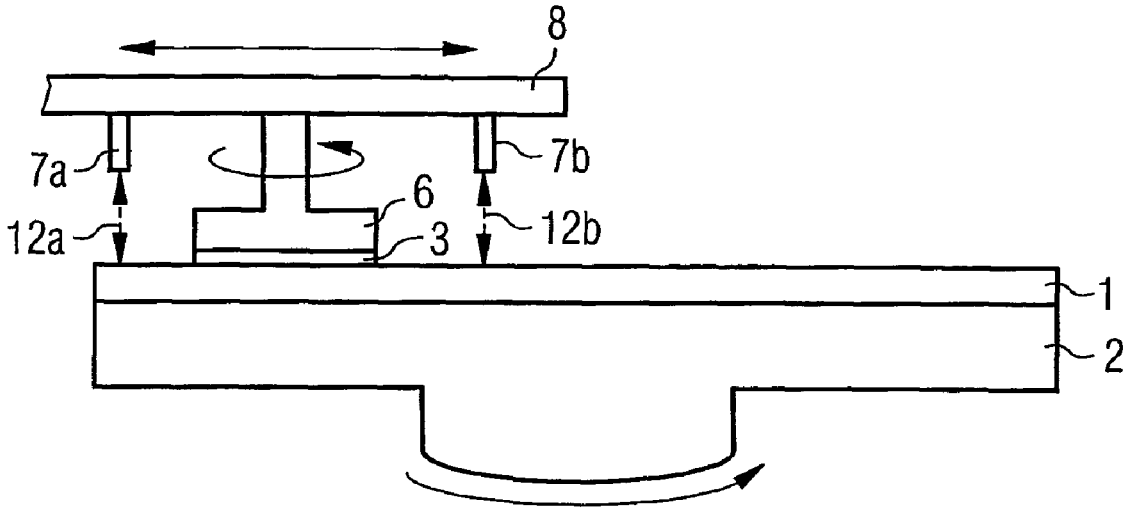
FIGS. 2A and 2B show an embodiment according to the present invention of two laser sensors mounted on the conditioning arm (a), and the principle of thickness removal measurement not drawn to scale (b)

In order to detect the profile inhomogeneities indicated in FIGS. 1A, 1B, and 1C, a first embodiment of the present invention as shown in FIG. 2A comprises two laser sensors directing perpendicularly with their beams onto the polishing pad 1. The laser sensors 7*a*, 7*b* are mounted to the conditioner oscillating arm 8 serving as a support for moving the conditioner 6 with the conditioning disk 3 across the polishing pad 1. A first laser sensor 7*b* is mounted on the oscillating arm 8 such that it detects the distance to the polishing pad surface representing that area which is not yet conditioned by the conditioning disk 3. E.g., a first distance 12*b* is measured for determining the thickness 10' of a pad surface element lying in the direction of movement of the conditioning disk 3. A second laser sensor 7*a* measures a second distance 12*a* on the opposite side of the oscillating arm 8 measuring the thickness 10 of a pad area that is already conditioned by the conditioning disk 3. Comparing the distance values 12*a* and 12*b*, or the thickness values 10 and 10', a removal 11 or surface material per conditioning cycle can be determined.

Figure 2B:
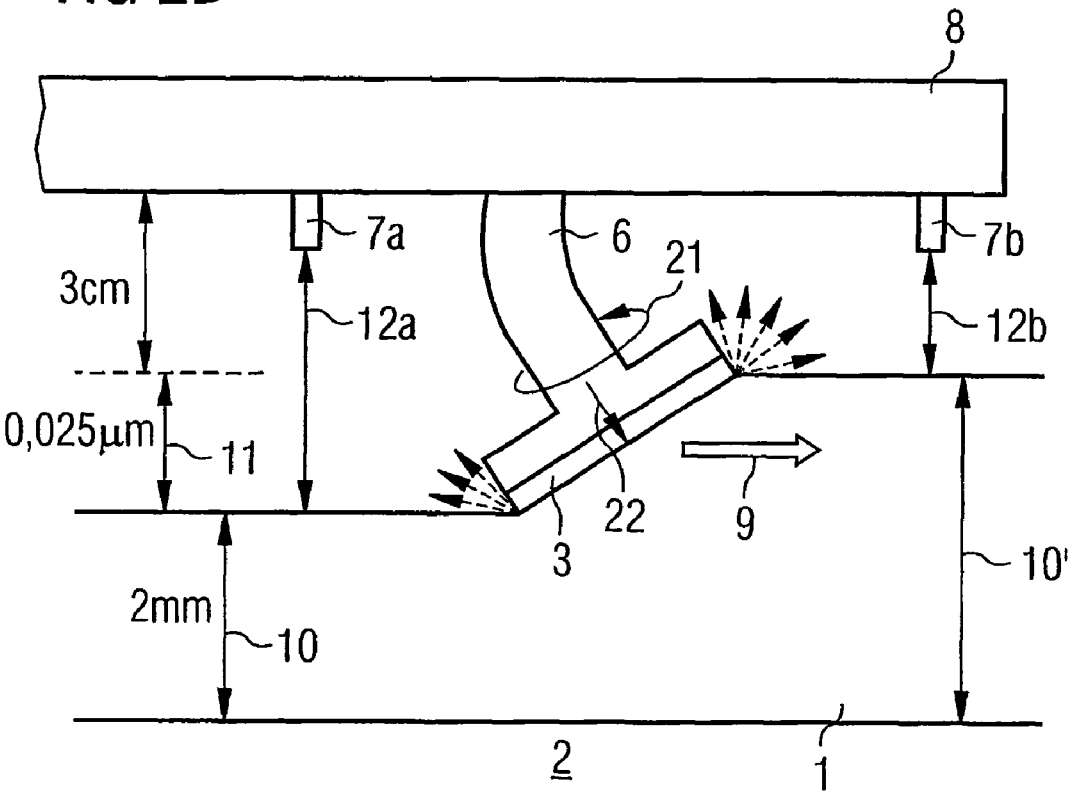

A schematic representation of the functionality of the embodiment is shown in FIG. 2B, which is not drawn to scale. The support arm 8 substantially retains the reference level of the laser sensor 7*a* and 7*b*, which is gauged by their distances to the bottom surface of the polishing pad 1 contacting the polishing platens 2 surface. Due to the thickness decrease during conditioning, the rotating conditioner 6 with the conditioning disk 3 moving across the polishing pad 1 in a direction 9 obtains a slightly bending figure. This means that the laser sensors 7*a*, 7*b* are substantially not affected by the slope of the conditioning disk 3 that just abrades the polishing pad 1 surface.

The amount of abrasion, i.e., removal, is controlled by the angular velocity 21 and the downward pressure force 22, or the oscillating arm 8 velocity into the direction of movement 9.

The actual polishing pad thickness 10 can be obtained in different ways. One is to rely on an initial thickness profile that is provided by the polishing pad manufacturer, and to subtract with each conditioning cycle the amount of removal 11 as a function of position as supplied by the oscillating arm 8 motor from the thickness of the previous cycle. Another possibility to determine the thickness is to use the absolute thickness measurements of laser sensors 7*a* and 7*b* for determining the thickness profile and to use the amount of removal 11 as a quantitative feedback input to the conditioner control. Combinations of both methods are possible as well.

Figure 3:
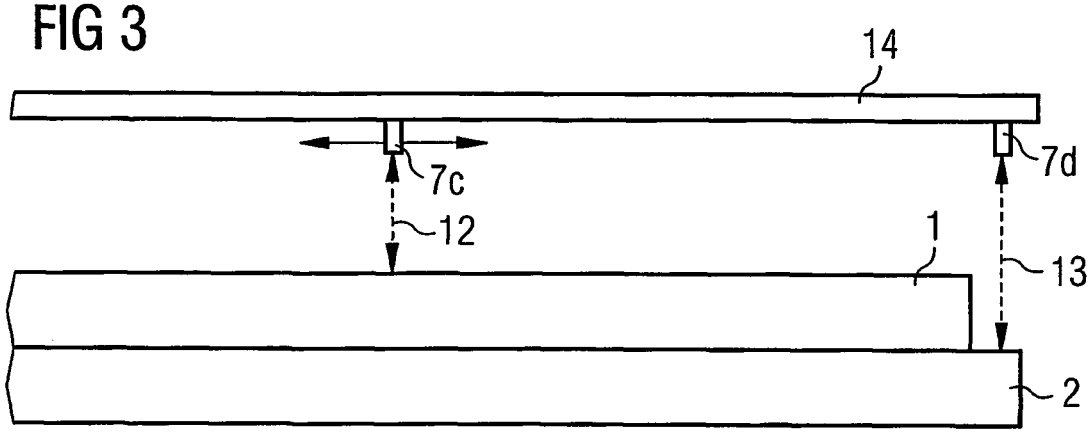
FIG. 3 shows another embodiment according to the present invention with a first laser sensor mounted on a guide rail and a second laser sensor performing a reference measurement.

A further embodiment of the present invention is shown in FIG. 3. A laser sensor 7*c* is mounted on a guide rail 14 that is mounted across the polishing pad 1 surface having a height. During or after a conditioning cycle, the laser sensor 7*c* moves along its guide rail 14 and performs the distance measurements for obtaining a thickness 10 profile as a function of position from each measured distance 12 between the laser sensor 7*c* and the polishing pad 1 surface. The reference level i.e., the laser sensor position or height, is gauged by a reference laser sensor 7*d* measuring the distance 13 of this reference level to the polish platen surface 2 at the edge of the polishing platen 2.

Figure 4:
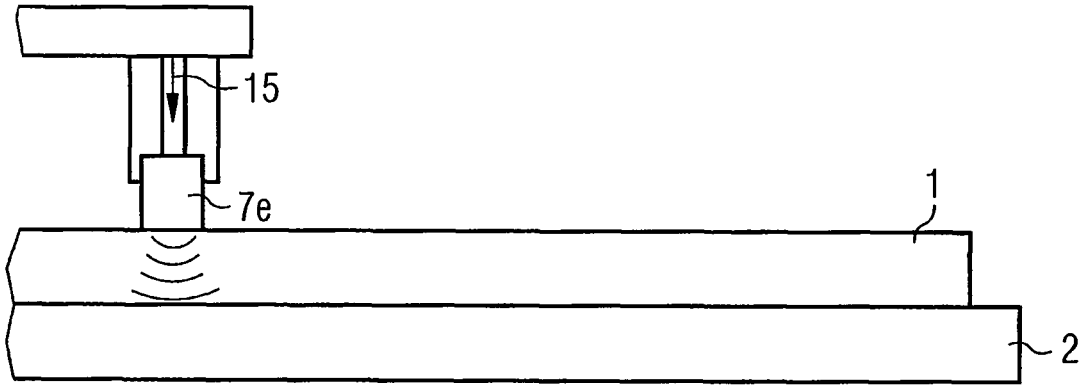
FIG. 4 shows a further embodiment according to the present invention using an ultrasonic sensor.

A still further embodiment is shown in FIG. 4. An ultrasonic sensor 7*e* is pressed onto the polishing pad 1 by of a downward pressure force 15 to be in contact with the polishing pad 1 surface. By emitting ultrasonic waves, which are reflected from the polishing platen 2 surface, the thickness 10 of the polishing pad 1 is directly measured. By performing a scanning movement, the arm holding and pressing the ultrasonic sensor 7*e* can obtain the thickness profile, preferably when the polishing table is not rotating.

Figure 5A:
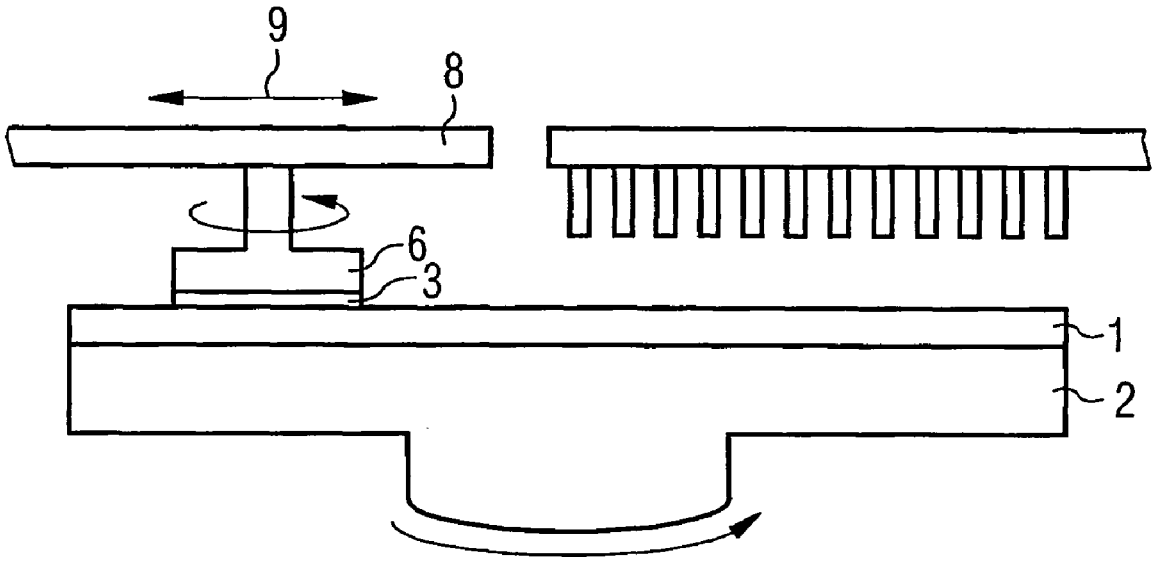
FIGS. 5A and 5B show a further embodiment using an array of laser sensors.
Figure 5B:
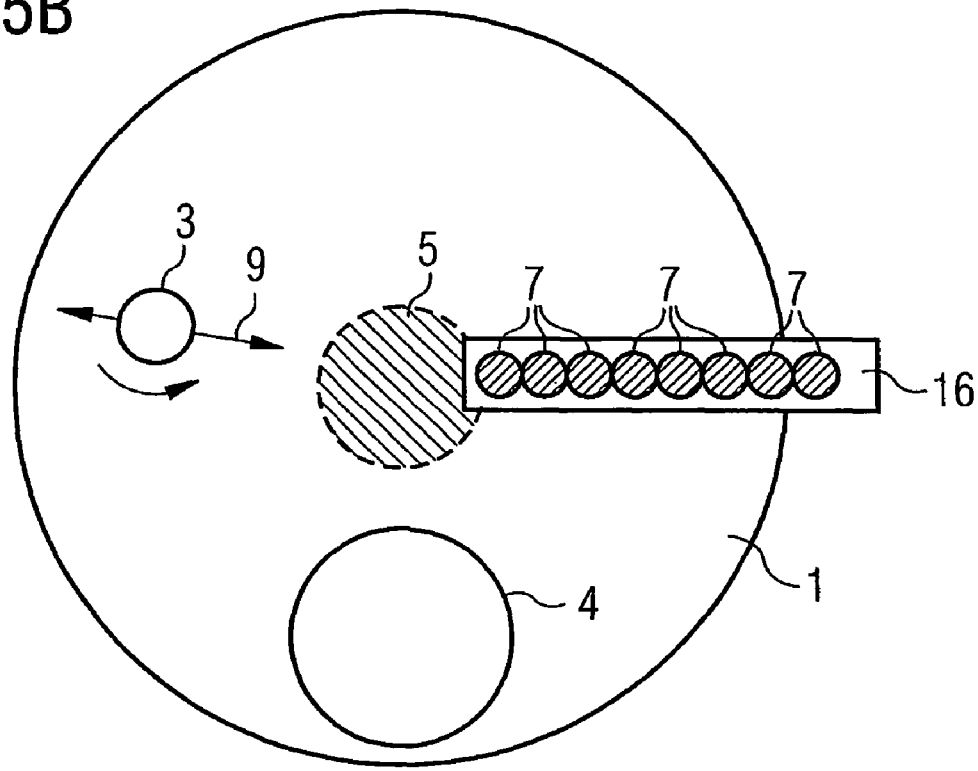

A still further embodiment is shown in FIGS. 5A and 5B. While the oscillating arm 8 performs an oscillating movement in directions 9, thereby conditioning the polishing pad 1 surface with the conditioning disk 3, an array of laser sensors 16 comprising a set of linearly arranged laser sensors 7 measures the thickness profile of the polishing pad without performing a movement by itself. Each laser sensor 7 corresponds to a radial position on the polishing pad surface 1 and development of profile slopes can be detected in-situ, in time and on-line. Advantageously, as shown in FIG. 5B, a semi-conductor wafer 4 can be polished and the polishing pad 1 be conditioned at the same time.

Advantageously, in all of the embodiments the use of the current polishing pad 1 is terminated when a predefined condition is met that a profile repair according to the method of the current invention, i.e., removing the inhomogeneities in the thickness profile, cannot be repaired further since either a minimum pad thickness has been reached or the polishing performance has dropped below preset requirements.

Each of the embodiments provides a thickness profile, e.g., thickness 10 of the polishing pad 1 as a function of radius position of the pad, which can be evaluated by the control unit calculating therefrom the necessary surface material removal 11 as a function of position then planned for the next conditioning cycle. From this removal profile, the control unit can determine the adjustment of angular velocity 21, downward pressure force 22 of the conditioning disk 3, or the oscillating arm velocity in the direction on movement 9. But also each embodiment provides a means for adjusting the conditioning disk parameters instantaneously, in particular in the embodiment according to FIG. 2 and FIG. 5. The detection of profile slopes at the current position of the conditioner 6 can also be provided by the embodiment of FIG. 3, when the movement of the laser sensor 7*c* along the guide rail 14 is sufficiently fast and the measurement duration is short. A refinement of the embodiment according to FIG. 3 is to provide a further laser sensor 7*c*, each of the laser sensors co-moving with the radius position of the conditioner 6 on the polishing pad 1, both having a similar relative position to the conditioner 6 as shown in FIG. 2A. The first laser sensor then measures the thickness in front of the conditioner, the other the thickness 10 behind the conditioner 6.

We claim:

1. An arrangement for conditioning a polishing pad, which is designed to perform chemical mechanical polishing of semiconductor devices, the polishing pad being mounted on a rotatable polishing platen, the arrangement comprising:

a conditioner comprising a conditioning disc, the conditioner being movable across the polishing pad; and a measurement unit for measuring the thickness of the polishing pad, the measurement unit including; at least one sensor for measuring a distance between a reference level and a surface element of the polishing pad, wherein the sensor is a laser sensor; and a control unit, connected to the at least one sensor, for calculating the thickness of the polishing pad from the distance measurement, wherein the at least one sensor comprises at least two laser sensors mounted to a support, the support also supporting the conditioning disc, wherein a first of the at least two laser sensors is mounted to the support on a first side, the first side being orientated towards a direction of movement of the conditioner, and a second of the at least two laser sensors is mounted to the support on a second side, the second side being opposite to the direction of movement.

2. The arrangement according to claim 1, the arrangement further comprising:

a motor for rotating the conditioning disc with an angular velocity, wherein the control unit is connected to the motor for adjusting the angular velocity during conditioning in response to a thickness measurement.

3. The arrangement according to claim 1, the arrangement further comprising:

a means for exerting a downward pressure force of the conditioning disc onto the polishing pad, wherein the control unit is connected to the means for exerting a downward pressure force for adjusting the downward pressure force in response to a thickness measurement.

4. The arrangement according to claim 1, the arrangement further comprising:

a database connected to the control unit with at least one pair of data, the data including a thickness and a radius position of a surface element of the polishing pad.

5. The arrangement according to claim 1, the arrangement further comprising:

at least one sensor has a thickness measurement resolution equal to or less than 0.025 μm.

6. A method for conditioning a polishing pad, the method comprising:

determining a thickness of the polishing pad;

measuring a first distance to a surface element of the polishing pad prior to applying a conditioner to that surface element;

applying the conditioner, comprising a conditioning disc, to the surface element of the polishing pad, wherein the conditioning disc has an angular velocity and a downward pressure force;

measuring a second distance to the surface element of the polishing pad after applying the conditioner to the surface element;

subtracting the first distance prior to the conditioner application from the second distance after the conditioner application; and calculating a new thickness of the polishing pad using subtracted distances using a control unit.

7. The method according to claim 6, the method further comprising:

repeating the steps for at least another surface element of the polishing pad for obtaining a thickness profile.

8. The method according to claim 6, the method further comprising:

comparing a determined thickness of a first surface element of the polishing pad with the thickness of a second surface element of the polishing pad; and issuing a signal in response to the comparison.

9. The method according to claim 8, the method further comprising:

adjusting at least one of angular velocity and downward pressure force of the conditioning disc in response to the signal.

* * * * *